US010857441B1

(12) United States Patent
Benavides

(10) Patent No.: US 10,857,441 B1
(45) Date of Patent: Dec. 8, 2020

(54) HEAD ALIGNMENT GOLF TRAINING AID

(71) Applicant: Ramon Benavides, Mission, TX (US)

(72) Inventor: Ramon Benavides, Mission, TX (US)

( * ) Notice: Subject to any disclaimer, the term of this patent is extended or adjusted under 35 U.S.C. 154(b) by 0 days.

(21) Appl. No.: 16/432,941

(22) Filed: Jun. 6, 2019

(51) Int. Cl.
*A63B 69/36* (2006.01)
*A63B 69/00* (2006.01)
*A63B 63/00* (2006.01)

(52) U.S. Cl.
CPC ..... *A63B 69/0057* (2013.01); *A63B 63/00* (2013.01); *A63B 69/36* (2013.01); *A63B 2225/093* (2013.01)

(58) Field of Classification Search
CPC ..... A63B 69/3641; A63B 2071/0694; A63B 71/022; A63B 63/00; A63B 69/36; A63B 69/3676; A63B 2069/3682; A63B 2063/001; A63B 2069/3629; A63B 2071/024; A63B 69/3658; A63B 69/0057; A63B 2225/093
USPC ..... 473/219, 257, 261, 264–268, 270, 272, 473/273
See application file for complete search history.

(56) References Cited

U.S. PATENT DOCUMENTS 3,853,325 A * 12/1974 Easterbrook ..... A63B 69/36 473/268
5,375,844 A * 12/1994 Waud ..... A63B 69/3623 473/268
7,520,825 B2 * 4/2009 Justice ..... A63B 63/003 473/170
7,670,231 B1 * 3/2010 Greene ..... A63B 69/3676 473/220
8,038,543 B2 * 10/2011 Capesius ..... A63B 69/0057 473/257

(Continued)

*Primary Examiner* — Nini F Legesse
(74) *Attorney, Agent, or Firm* — Kimberly Mclean; Mclean Law LLC

(57) ABSTRACT

A head alignment golf training aid system including a configurable frame assembly and a net member. The configurable frame assembly having a top section, middle section and bottom section, all sections collectively forming an inverted L shaped frame having a rectangular base when the frame assembly is configured. The top section includes a horizontal bar member, a support bracket member to steady the top section of the frame assembly, an alignment bar member which aids in orienting a user's head to a required position to obtain a desired golf swing, wherein the position of the alignment bar member relative to a user is adjustable to achieve a suitable orientation, and an elbow connector member for connecting the alignment bar member to the horizontal bar member. The middle section includes a vertically oriented pole member and the bottom section includes a rectangular base member having enclosed therein one or more golf tees. The rectangular base member is prefilled with weighted material to stabilize the configured frame assembly. The net member having a semicircle shaped net frame member and a screen member which attachably connects to the net frame member, the net member including designation labels, each located at a predetermined position on the screen member, wherein each designation label identifies a characteristic about the user's golf swing when a golf ball shot by the user hits the net member at one of the predetermined positions of the designation labels.

11 Claims, 3 Drawing Sheets

(56) References Cited

U.S. PATENT DOCUMENTS

| | | | | |
|---|---|---|---|---|
| 2003/0207716 | A1* | 11/2003 | Bradstock | A63B 69/3623<br>473/194 |
| 2005/0272518 | A1* | 12/2005 | Bennett | A63B 69/3641<br>473/261 |
| 2007/0238540 | A1* | 10/2007 | Lin | A63B 63/00<br>473/172 |

* cited by examiner

HEAD ALIGNMENT GOLF TRAINING AID

FIELD OF THE INVENTION

Embodiments described herein generally relate to golf training aids, and more particularly to a head alignment golf training aid.

BACKGROUND OF THE INVENTION

Golfing is the type of sport where one bad habit can tinker with the remainder of a players form on the swing. Head position in the golf stance directly influences the shape of the swing. The position of the head at address determines the angle of the spine, and the angle of the spine determines the shoulder plane, and the shoulder plane affects the golf swing. Many people have an issue keeping their head or back from moving on the follow through which can cause the shot to veer off course. Hence what is needed is a way for a golfer to learn how to control his/her head movements in order to obtain an improved golf swing.

BRIEF DESCRIPTION OF THE DRAWINGS

The various advantages of the embodiments of the present disclosure will become apparent to one skilled in the art by reading the following specification and appended claims, and by referencing the following drawing(s), in which:

SUMMARY OF THE INVENTION

Figure 1:
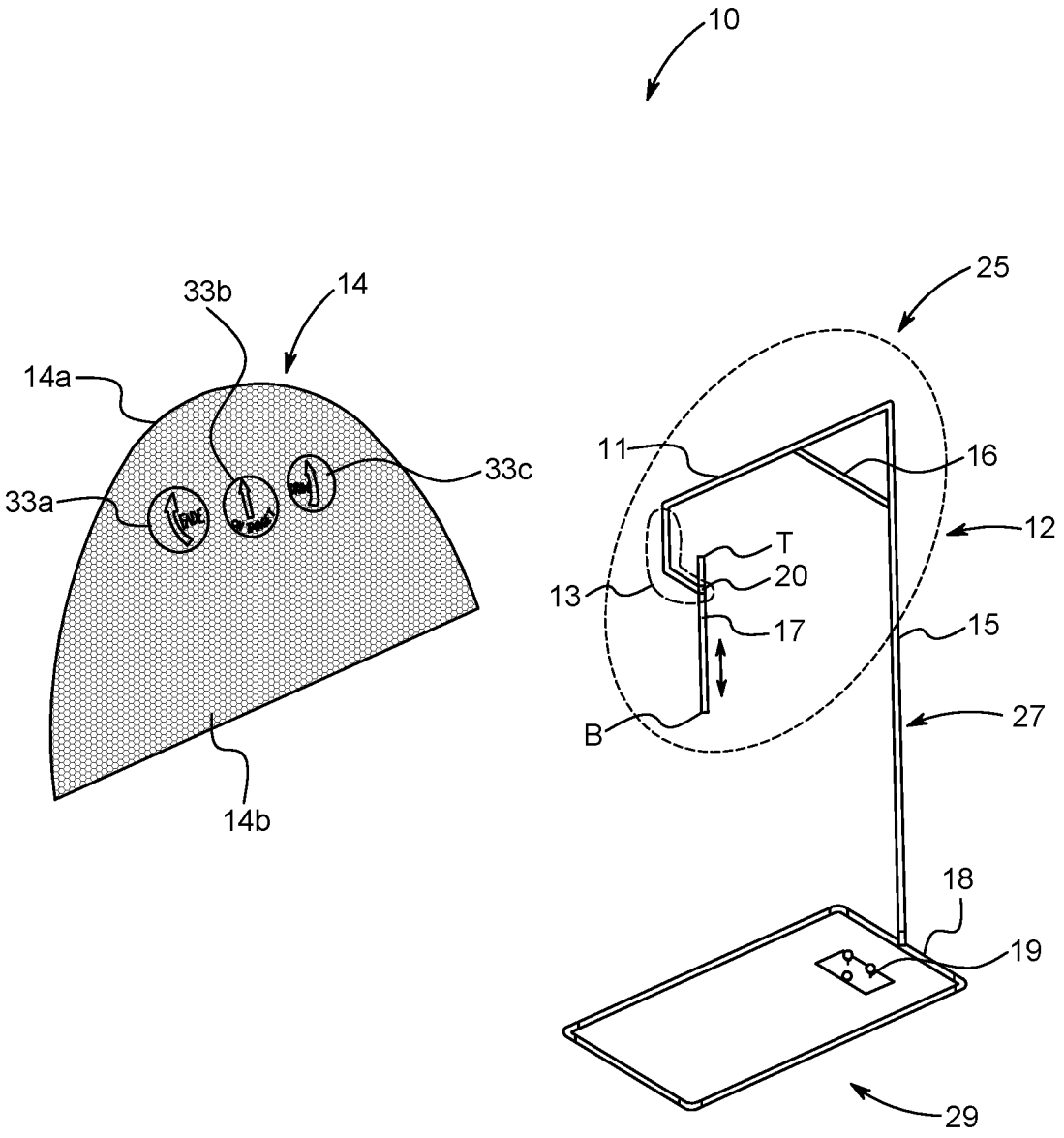
FIG. 1 shows an exemplary view of a head alignment golf training aid according to an embodiment of the present disclosure.

Exemplary embodiments disclosed herein describe a head alignment golf training aid system including a configurable frame assembly and a net member. The configurable frame assembly having a top section, middle section and bottom section, all sections collectively forming an inverted L shaped frame having a rectangular base when the frame assembly is configured. The top section includes a horizontal bar member, a support bracket member to steady the top section of the frame assembly, an alignment bar member which aids in orienting a user's head to a required position to obtain a desired golf swing, wherein the position of the alignment bar member relative to a user is adjustable to achieve a suitable orientation, and an elbow connector member for connecting the alignment bar member to the horizontal bar member. The middle section includes a vertically oriented pole member and the bottom section includes a rectangular base member having enclosed therein one or more golf tees. The rectangular base member is prefilled with weighted material to stabilize the configured frame assembly. The net member having a semicircle shaped net frame member and a screen member which attachably connects to the net frame member, the net member including designation labels, each located at a predetermined position on the screen member, wherein each designation label identifies a characteristic about the user's golf swing when a golf ball shot by the user hits the net member at one of the predetermined positions of the designation labels.

In some exemplary embodiments, the elbow connector member includes a circular fitting member for receiving the alignment bar member, the circular fitting member allows the alignment bar member to rotate clockwise and counter-clockwise and to slide upwards and downwards.

In some exemplary embodiments, the alignment bar member includes a plurality of equidistant apertures aligned vertically along the alignment bar member, wherein each aperture represents a measurement unit which is used to determine an adjustment amount for the adjustable alignment bar.

In some exemplary embodiments, the alignment bar member includes a top region and a bottom region.

In some exemplary embodiments, the distance between the base frame member and the bottom region of the alignment bar member is adjusted based on the height of the user.

In some exemplary embodiments, the distance between the base frame member and the bottom region of the alignment bar member is adjustable by sliding the alignment bar member to different positions on the bar member designated by the plurality of apertures aligned along the alignment bar member.

In some exemplary embodiments, the alignment bar member is positioned to line up with a front surface of a user's ear to prevent the user's head from moving.

In some exemplary embodiments, the position of the alignment bar member is swiveled one hundred and eighty (180) degrees depending upon whether the user is left handed or right handed.

In some exemplary embodiments, a lock mechanism is inserted into the hole of the elbow connector and through the hole of the alignment bar member to lock the alignment bar member at a particular position.

DETAILED DESCRIPTION

The present disclosure relates to a head alignment golf training aid system ("the system"). The system alters the direction of a swing by giving a player a way of keeping their head fixed at the correct angle. The system is made out of a series of PVC pipes that acts as a frame and also features a net to catch a golfer's shots during practice. Further, the system allows a player to line their head up perfectly so that they may practice form and improve accuracy overall.

Figure 2:
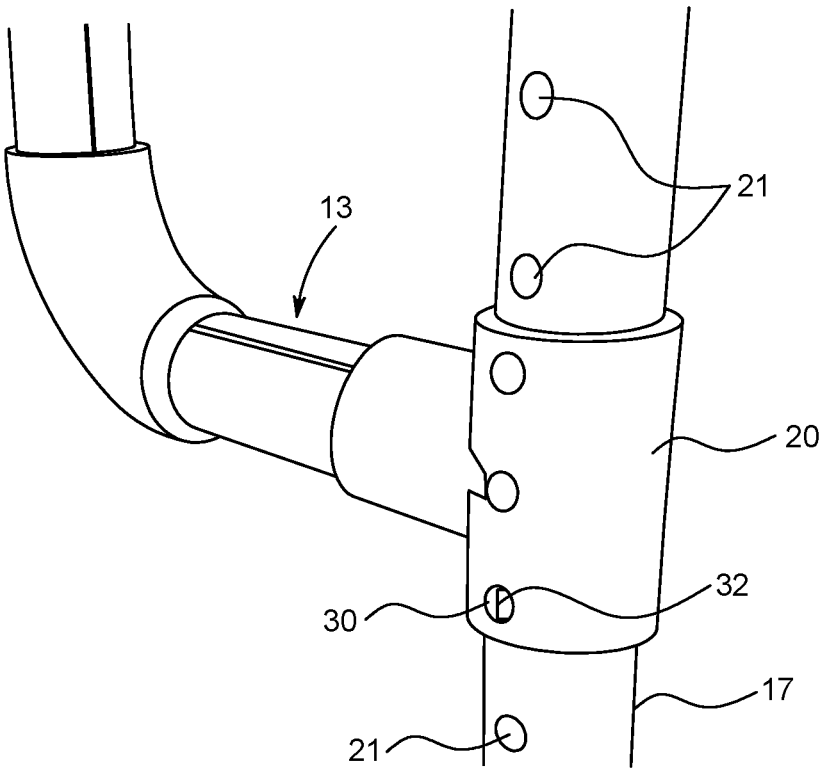
FIG. 2 shows an exemplary sectional view of the alignment bar member and the elbow connector member of the head alignment golf training aid according to an embodiment of the present disclosure.
Figure 3:
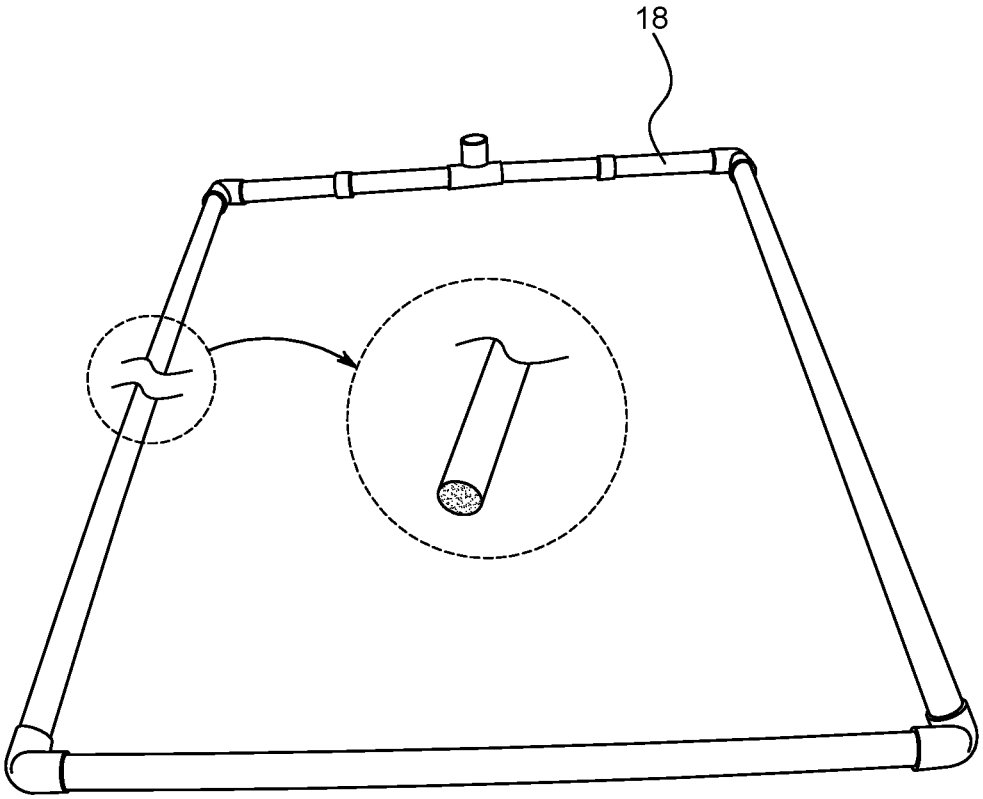
FIG. 3 shows an exemplary sectional view of the base frame member 18 of the head alignment golf training aid according to an embodiment of the present disclosure.

As illustrated in FIGS. 1-3, the system 10 includes a frame assembly 12, a net 14, and at least one golf tee 19. The frame assembly 12 includes pole member 15, support bracket member 16, alignment bar member 17, and base frame member 18. When the frame assembly is assembled, the frame includes a top section 25, middle section 27 and bottom section 29. All of the sections collectively form an inverted L shaped frame having a rectangular base. The assembled frame includes tubing, connectors and hinges and may be made of any suitable material, such as, for example, plastic, polyvinyl chloride, etc. The assembled frame may be disassembled for storage when not in use.

The top section 25 of the assembled frame includes a horizontal bar member 11, support bracket member 16, which steadies the top section of the frame assembly, alignment bar member 17, which aids in orienting a user's head to a required position to obtain a desired golf swing, and an elbow connector member 13 for connecting the alignment bar member to the horizontal bar member. The elbow connector member includes a circular fitting member

20 for receiving the alignment bar member. The circular fitting member allows the alignment bar member to rotate clockwise and counter-clockwise and to slide upwards and downwards.

The alignment bar member 17 includes a top region T and a bottom region B. Additionally, the alignment bar member includes a plurality of equidistant apertures 21 aligned vertically along the alignment bar member. Each aperture represents a measurement unit which is used to determine an adjustment amount for the adjustable alignment bar. The distance between the base frame member 19 and the bottom region B of the alignment bar member 17 is adjustable by sliding the alignment bar member to different positions on the bar member designated by the plurality of apertures aligned along the alignment bar member. The distance between the base frame member and the bottom region of the alignment bar member is adjusted based on the height of the user.

The alignment bar member 17 is adjustable such that the position of the alignment bar member relative to a user is altered to achieve a suitable orientation. The alignment bar member is positioned to line up with a front surface of a user's ear to prevent the user's head from moving. The position of the alignment bar member may be swiveled one hundred and eighty (180) degrees to achieve proper orientation depending upon whether the user is left-handed or right-handed. More particularly, the alignment bar member may be turned one hundred and eighty (180) degrees when changing the position orientation of the frame assembly 12 from a right-handed user to a left-handed user and vice versa. A lock mechanism 32 may be inserted into the hole 30 of the elbow connector 13 and through the hole (i.e., one of the plurality of apertures) 21 of the alignment bar member 17 to lock the alignment bar member at a particular position.

The middle section of the assembled frame 12 includes vertically oriented pole member 15. The pole member 15 may have a fixed length. In another embodiment, the length of the pole member may be adjusted.

The bottom section of the assembled frame 12 includes a base frame member 18 having a rectangular shape and having enclosed therein one or more golf tees 19. The position of the rectangular base frame member is adjustable to achieve a suitable orientation of the frame assembly relative to the user. So, for example, the base member 18 may be turned one hundred and eighty (180) degrees when changing the position orientation of the frame assembly 12 from a right-handed user to a left-handed user and vice versa. The rectangular base frame member is prefilled with weighted material to stabilize the configured frame assembly. The one or more golf tees are stands used to support a stationary ball so that a player can strike it, particularly in golf. Any conventional tees may be used in the system.

The net 14 includes a frame member 14*a* and a screen member 14*b*. The net is positioned a predetermined distance away from the assembled frame so that a ball (i.e., golf ball) hit by a user may be caught in the net. The frame member and the screen member may have a semicircle shape. The screen member attachably connects to the frame member. Designation labels 33*a*-33*c*, such as, for example, "fade" 33*a*, "on target" 33*b*, and "draw" 33*c* are located on a front surface of the screen member when attached to the frame member. Each label is located at a predetermined position on the screen member. Each designation label identifies a characteristic about the user's golf swing when a golf ball shot by the user hits the net member at one of the predetermined positions of the designation labels. When the user's ball hits the fade designation, the user executed a fade swing. When the user's ball hits the draw designation, the user executed a draw swing. A draw curves from the user's right to his left (for a right-handed golfer) while a fade moves in the opposite direction, from left to right. The designation labels aid the user with practicing his/her golf swing.

The system 10, including the net 14, may be used in every driving range, school or any facility that has golf, including a backyard. The system is primarily an outdoor system where the balls (e.g., golf balls) are to be hit off the grass. However, the system may be used indoors during inclement weather or during the winter months.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.)

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A head alignment golf training aid system comprising:

a configurable frame assembly having a top section, middle section and bottom section, all sections collectively forming an inverted L shaped frame having a rectangular base when the frame assembly is configured, the top section includes a horizontal bar member, a support bracket member to steady the top section of the frame assembly, an alignment bar member which aids in orienting a user's head to a required position to obtain a desired golf swing, wherein the position of the alignment bar member relative to a user is adjustable to achieve a suitable orientation, and an elbow connector member for connecting the alignment bar member to the horizontal bar member, the middle section includes a vertically oriented pole member and the bottom section includes a rectangular base frame member having enclosed therein one or more golf tees, wherein the position of the rectangular base frame member is adjustable to achieve a suitable orientation of the frame assembly relative to the user; and a net member having a semicircle shaped net frame member and a screen member which attachably connects to the net frame member, the net member including designation labels, each located at a predetermined position on the screen member, wherein each designation label identifies a characteristic about the user's golf swing when a golf ball shot by the user hits the net member at one of the predetermined positions of the designation labels.

2. The system of claim 1, wherein the elbow connector member includes a circular fitting member for receiving the alignment bar member, the circular fitting member allows the alignment bar member to rotate clockwise and counterclockwise and to slide upwards and downwards.

3. The system of claim 1, wherein the alignment bar member includes a plurality of equidistant apertures aligned vertically along the alignment bar member, wherein each aperture represents a measurement unit which is used to determine an adjustment amount for the adjustable alignment bar.

4. The system of claim 1, wherein the alignment bar member includes a top region and a bottom region.

5. The system of claim 4, wherein the distance between the base frame member and the bottom region of the alignment bar member is adjusted based on the height of the user.

6. The system of claim 4, wherein the distance between the base frame member and the bottom region of the alignment bar member is adjustable by sliding the alignment bar member to different positions on the bar member designated by the plurality of apertures aligned along the alignment bar member.

7. The system of claim 1, wherein the alignment bar member is positioned to line up with a front surface of a user's ear to prevent the user's head from moving.

8. The system of claim 1, wherein the position of the alignment bar member is turned one hundred and eighty (180) degrees when changing a position orientation of the configurable frame assembly from a right-handed user to a left-handed user.

9. The system of claim 1, wherein a lock mechanism is inserted into the hole of the elbow connector and through the hole of the alignment bar member to lock the alignment bar member at a particular position.

10. The system of claim 1, wherein the rectangular base member is prefilled with weighted material to stabilize the configured frame assembly.

11. The system of claim 1, wherein the position of the rectangular base frame member is turned one hundred and eighty (180) degrees when changing a position orientation of the configurable frame assembly from a right-handed user to a left-handed user.

* * * * *